US005191978A

United States Patent [19]

Strader et al.

[11] Patent Number: 5,191,978

[45] Date of Patent: Mar. 9, 1993

[54] LOCKER SET FOR STORING GOLF EQUIPMENT

[75] Inventors: Stuart W. Strader, Portland; John P. Wells, Molalla, both of Oreg.

[73] Assignee: Strader, Wells & Jamison, Inc., Portland, Oreg.

[21] Appl. No.: 732,608

[22] Filed: Jul. 19, 1991

[51] Int. Cl.[5] ..... A63B 55/00; A63B 55/08; A63B 57/00

[52] U.S. Cl. ..... 206/315.2; 206/315.4; 211/71; 248/96; 312/198

[58] Field of Search ..... 206/315.2, 315.4, 315.3, 206/315.6, 315.7, 315.8; 52/65, 793; 211/70.2, 71; 248/96; 312/198, 199; 280/DIG. 6

[56] References Cited

U.S. PATENT DOCUMENTS

| | | | |
|---|---|---|---|
| 1,624,714 | 4/1927 | Bullock | 206/315.2 X |
| 3,563,624 | 2/1971 | Stice | 312/198 X |
| 3,602,567 | 8/1971 | Schnell et al. | 312/198 X |
| 4,016,686 | 4/1977 | Hartger et al. | 312/199 X |
| 4,045,103 | 8/1977 | Paolina | 312/198 |
| 4,084,867 | 4/1978 | Putt et al. | 312/198 |
| 4,375,847 | 3/1983 | Picco | 206/315.2 |
| 4,391,377 | 7/1983 | Ziaylek, Jr. | 211/71 |
| 4,983,089 | 1/1991 | Rose | 52/79.3 X |
| 4,986,425 | 1/1991 | Gohl | 312/198 X |
| 5,087,003 | 2/1992 | Montgomery | 312/198 X |

FOREIGN PATENT DOCUMENTS

| | | | |
|---|---|---|---|
| 2250769 | 4/1974 | Fed. Rep. of Germany | 312/198 |
| 3333463 | 4/1985 | Fed. Rep. of Germany | 312/198 |

*Primary Examiner*—Sue A. Weaver
*Attorney, Agent, or Firm*—Klarquist, Sparkman, Campbell, Leigh & Whinston

[57] ABSTRACT

A set of lockers having downwardly inclined bottom walls to urge golf club bags including golf clubs away from a first end wall, including a locker door, toward a second end wall at the rear of the locker.

4 Claims, 1 Drawing Sheet

LOCKER SET FOR STORING GOLF EQUIPMENT

BACKGROUND OF THE INVENTION

This invention relates to lockers for storing golf equipment, and more particularly, to lockers for storing golf club bags and golf club carts.

Storing golf equipment in lockers has many advantages including providing golfers with an alternative to bringing clubs into a clubhouse, thus decreasing the risk of theft. However, when storing the bags with golf clubs in them in a locker, it is desirable that the clubs in the bags be stored in such a way that they will not fall out when the locker door is opened. Lockers presently available have bottom walls substantially parallel to the floor on which the lockers are standing. When a golf club bag, filled with golf clubs, is placed in such a locker, the bag is often inserted with the closed bottom side toward the back and with the open top side facing the locker door. This sometimes results in the golf clubs falling out of the bag, either on the person opening the locker door or onto the floor.

Accordingly, a principal object of the present invention is to provide a locker having a bottom wall defining a floor that is inclined downwardly as it extends from a first end wall, on which the locker door is mounted, toward a second end wall interiorly thereof. Such a floor effectively urges golf clubs in a bag away from the first end wall and towards the second end wall.

Another object of the invention is to provide a bottom wall design that is sufficiently downwardly inclined away from the locker door to urge most golf clubs toward the bottom of a golf club bag. Such prevents golf clubs, which normally might fall out of a bag if placed in a locker having a bottom wall parallel to the floor, from falling out through the generally open top of the bag when the locker door is opened.

SUMMARY OF THE INVENTION

This invention provides a set of lockers having downwardly inclined bottom walls to urge golf club bags including golf clubs away from a first end wall including a locker door toward a second end wall at the rear of the locker. The invention prevents golf clubs from falling out of the locker through the open end of a golf club bag when the looker door is opened.

In accordance with a preferred embodiment, a set of lockers includes lower and upper bag enclosures for storing golf club bags and a cart enclosure for storing golf club carts. The bag enclosures are vertically positioned above the cart enclosure. Each of the lower and upper bag enclosures and the cart enclosure has a first vertical end wall pivotally mounted to serve as a door to the respective enclosure. A golf club cart is disposed in the cart enclosure which is large enough to permit the cart to be easily rolled in and out on the bottom wall thereof. A golf club bag, having an open top and a closed bottom, including golf clubs, may be disposed in each of the lower and upper bag enclosure with the open top of the bag adjacent to the first end wall. Each bag enclosure has a downwardly inclined bottom wall which urges the golf club bag, including the clubs, toward the second vertical end wall thereof.

DETAILED DESCRIPTION OF THE PREFERRED EMBODIMENT

Figure 1:
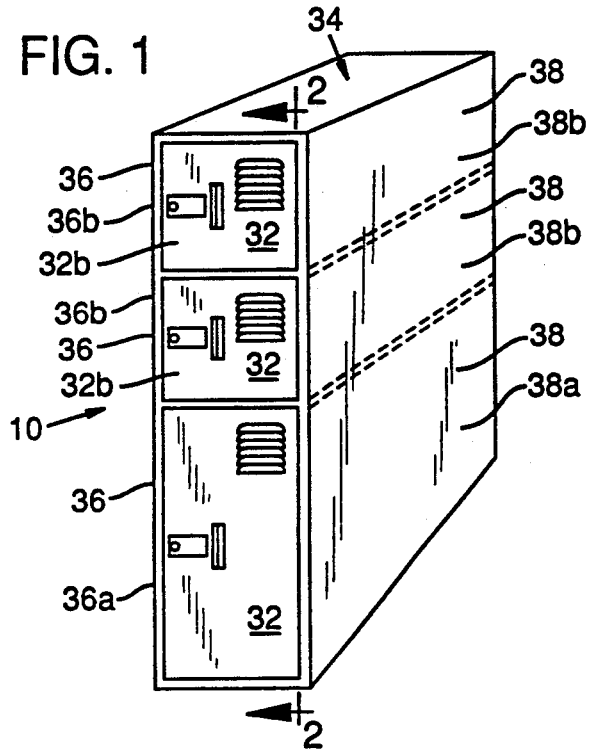
FIG. 1 is a perspective view of a set of lockers in accordance with the present invention.
Figure 2:
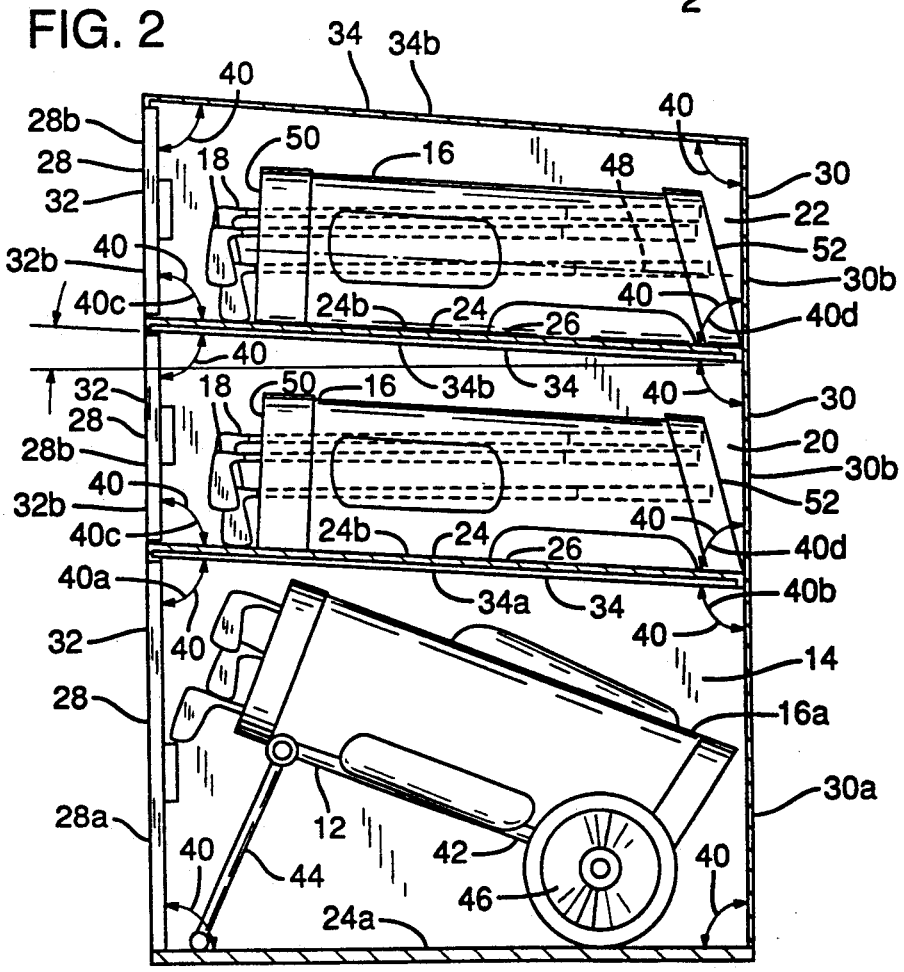
FIG. 2 is a sectional view taken on line 2—2 of FIG. 1.

Referring to the drawings, a preferred embodiment of the invention is illustrated in the form of a set of lockers 10 for storing a golf club cart 12 in a cart enclosure 14, and golf club bags 16 filled with a plurality of golf clubs 18 disposed in lower and upper bag enclosures 20, 22. Bottom walls 24 of the bag enclosures 20, 22 define floors 26 thereof that are inclined downwardly as they extend from first end walls 28 toward second end walls 30 rearwardly thereof. Locker doors 32 are pivotally mounted on first end walls 28. The floor inclination from front to rear prevents the clubs 18 from falling out when the doors **32*b*** are opened.

As shown in the drawings, the bag enclosures 20, 22 are vertically positioned above the cart enclosure 14. Each of the enclosures is defined by bottom and top walls 24, 34, first and second vertical side walls 36, 38 and first and second vertical end walls 28, 30.

The bottom and top walls 24, 34 are rectangular in shape and have lengths that are at least twice as long as their widths. In the preferred embodiment, the lengths of the bottom and top walls 24, 34 (and thus the length of the locker itself) are about 52 inches and the widths (and thus the width of the locker itself) are about 20 inches. Each of the vertical side walls **36*a*, 38*a* of the cart enclosure 14 is approximately 52 inches long and 34.5 inches high. Each of the vertical sidewalls 36*b*, 38*b* of the bag enclosures 20, 22 is approximately 52 inches long and 17 inches high. The height of a first end wall 28*a* of the cart enclosure 14** is about 34.5 inches and the width is about 20 inches.

Considering the cart enclosure 14 as a separate entity, each of the side walls **36*a*, 38*a* has four corners 40. The heights of the side walls 36*a*, 38*a* are progressively reduced from about 34.5 inches at the corner 40*a*, adjacent the first end wall 28*a*, to about 32.5 inches at the corner 40*b*, adjacent the second end wall 30*a* thereof. A golf club cart may be disposed in the cart enclosure 14. The cart 12 has a frame portion 42, a handle portion 44 and a wheel portion 46. The frame portion 42 is adapted to carry a golf club bag 16*a*. The frame portion 42 has fasteners to which the bag 16*a* can be securely attached. The handle portion 44 is attached to the frame portion 42. The handle portion 44 is used to push and pull the cart 12 while the cart is carrying the bag 16*a*. The wheel portion 46 is mounted underneath the frame portion 42 to permit the cart 12 to be rolled on the bottom wall 24*a* and to facilitate withdrawal of the cart 12 from the cart enclosure 14. The wheel portion 46** can also be rolled on other surfaces such as grass, asphalt and concrete.

Considering each of the bag enclosures 20, 22 as a separate entity, each has first and second vertical sidewalls **36*b*, 38*b* which also have four corners 40. Each corner 40*c*, adjacent to the bottom walls 24*b* and the first end walls 28*b*, defines an angle greater than 90°. Each corner 40*d*, adjacent to the bottom walls 24*b* and the second end walls 30*b*, defines an angle less than 90°. In the illustrated embodiment, the bottom wall 24*b* of each bag enclosure 20, 22 slopes downwardly about two inches as it extends from the front end wall 32*b* to the rear end wall 30*b***.

The golf club bags 16, with the golf clubs 18 inside, are disposed in the lower and upper bag enclosures 20, 22. Each of the golf club bags 16 has a longitudinal axis 48 extending from the generally open top 50 to the closed bottom 52. Each of the bags 16 is disposed in the bag enclosures 20, 22 such that the longitudinal axis 48 is generally parallel to the bottom wall 24*b* and the open top 50 is positioned adjacent to the first end walls 28*b*. Due to inclined bottom walls 24*b*, the golf clubs 18, disposed in the bags 16, are urged toward the closed bottoms 52 of the bags 16. The downwardly inclined bottom walls 24*b* prevent the golf clubs 18 from sliding toward the first end walls 28*b* when the locker doors 32*b*, attached to the first end walls 28*b*, are opened.

The set of lockers can also be fabricated with several bag enclosures 20, 22 vertically positioned on top of or below the cart enclosure 14. Also, bag enclosures can be vertically positioned on top of each other without the use of cart enclosure 14.

Sturdy 16 inch gauge galvanized sheet metal construction, in combination with weather-resilient polyester powder coating, has been found to provide adequate mechanical properties for the lockers. Other materials such as plastics and wood may also prove to be suitable construction materials.

Having described and illustrated the principles of our invention with reference to one preferred embodiment thereof, it will be apparent that the invention can be modified in arrangement and detail without departing from such principles. For example, while the invention has been illustrated with reference to a locker cabinet that includes a cart enclosure as well as several bag enclosures, it will be recognized that the invention can be advantageously practiced with a locker cabinet comprised exclusively of bag enclosures. One such embodiment employs four bag enclosures. Similarly, while the invention has been illustrated with reference to a locker cabinet wherein the bottom floors of all the bag enclosures are parallel to each other, in other embodiments it may be advantageous (such as for commonality of parts) that each floor be sloped progressively more than the floor of the enclosure below. This may be accomplished, for example, by making each of end walls 32*b* one inch taller than each of end walls 30*b*. If four such bag enclosures are stacked, the top of the locker cabinet will be four inches higher at its front end than at its back end. This progressive floor sloping also provides increased protection against clubs toppling out of bags in the upper lockers, where such protection is needed the most.

In view of the variety of embodiments to which the principles of the present invention can be applied, it should be recognized that the detailed embodiment is illustrative only and should not be taken as limiting the scope of our invention. Rather, we claim as our invention all such modifications as may fall within the scope and spirit of the following claims and equivalents thereto.

We claim:

1. A set of lockers for storing golf equipment comprising:

first and second enclosures, each of the enclosures being defined by top and bottom walls, first and second vertical side walls, and first and second vertical end walls, the first enclosure being disposed above the second enclosure;

the top and bottom walls having a length and a width;

each of the side walls having a length and a height, and each of the end walls having a height and a width, the widths of each of the end walls being substantially equal;

the first and second end walls of each enclosure being rectangular in shape, the first end wall of each enclosure comprising a door and including means for pivotally mounted said door to provide access to the enclosure;

the lengths of the top and bottom walls of the first and second enclosures being longer, by at least a factor of two, than the widths of the walls;

the top and bottom walls of each enclosure being rectangular in shape;

the end walls of both the first and second enclosures being oriented vertically;

the first and second side walls of the first enclosure each having four corners, the corner adjacent to the bottom wall and the first end wall defining an angle greater than ninety degrees and the corner adjacent to the bottom wall and the second end wall defining an angle less than ninety degrees;

the second end wall of the second enclosure having a height substantially less than the height of the first end wall of the second enclosure;

wherein the bottom wall of the first enclosure defines a floor thereof that is inclined downwardly as it extends from the first end wall to the second end wall thereof.

2. In combination, a set of lockers for storing golf equipment including a golf club bag and a golf club cart;

the set of lockers comprising first and second enclosures, each of the enclosures being defined by top and bottom walls, first and second vertical side walls, and first and second vertical end walls, the first enclosure being disposed above the second enclosure;

the top and bottom walls having a length and a width;

each of the side walls having a length and a height, and each of the end walls having a height and a width, the widths of each of the end walls being substantially equal;

the first and second end walls of each enclosure being rectangular in shape, the first end wall of each enclosure comprising a door and including means for pivotally mounting said door to provide access to the enclosure;

the lengths of the top and bottom walls of the first and second enclosures being longer, by at least a factor of two, than the widths of the walls;

the heights of the end walls of the second enclosure being substantially greater than the widths of the end walls;

the top and bottom walls of each enclosure being rectangular in shape;

the end walls of both the first and second enclosures being oriented vertically;

the first and second side walls of the first enclosure each having four corners, the corner adjacent to the bottom wall and the first end wall defining an angle greater than ninety degrees and the corner adjacent to the bottom wall and the second end wall defining an angle less than ninety degrees;

the second end wall of the second enclosure having a height substantially less than the height of the first end wall of the second enclosure;

wherein the bottom wall of the first enclosure defines a floor thereof that is inclined downwardly as it extends from the first end wall to the second end wall thereof;

the golf club bag being disposed in the fist enclosure;

the golf club bag including a plurality of golf clubs;

the golf club bag having a longitudinal axis and comprising generally an open top and a closed bottom;

the golf club bag being disposed in the first enclosure with the longitudinal axis generally parallel to the bottom wall of the first enclosure and the open top adjacent to the first end wall, for urging the golf clubs int he golf club bag toward the bottom of the golf club bag;

the golf club cart being disposed in the second enclosure, the golf club having a frame portion, a handle portion, and a wheel portion;

the frame portion being adapted for carrying a second golf club bag;

the handle portion being integral with the frame portion for pushing or pulling the golf club cart;

the wheel portion being mounted on the frame portion, the wheel portion, the wheel portion being positioned to permit the golf club cart to be rolled on the bottom wall of the second enclosure to facilitate withdrawal of the card from the second enclosure.

3. A set of lockers for strong gold equipment comprising:

first and second enclosures, each of the enclosures being defined by top and bottom walls, first and second vertical side walls, and first and second vertical end walls, the first enclosure being disposed above the second enclosure;

the top and bottom walls having a length and a width;

each of the side walls having a length and a height, and each of the end walls having a height and a width, the widths of each of the end walls being substantially equal;

the first and second end walls of each enclosure being rectangular in shape, only the first end wall of each enclosure comprising a door and including means for pivoting mounting said door to provide sole access to the enclosure;

the lengths of the top and bottom walls of the first and second enclosures being longer, by at least a factor of two, than the widths of the walls;

the top and bottom walls of each enclosure being rectangular in shape;

the end walls of both the first and second enclosures being oriented vertically;

the first and second side walls of the first and second enclosures each having four corners, the corners adjacent to each of the bottom walls and each of the first end walls defining an angle greater than ninety degrees and the corners adjacent to each of the bottom walls and each of the second end walls defining an angle less than ninety degrees;

wherein the bottom walls of the first and second enclosures each defines a floor thereof that is inclined downwardly as it extends from the first end wall to the second end wall thereof.

4. In combination, a set of lockers for storing golf equipment including a first golf club bag and a second golf club bag;

the set of lockers comprising first and second enclosures, each of the enclosures being defined by top and bottom walls, first and second vertical side walls, and first and second vertical end walls, the first enclosure being disposed above the second enclosure;

the top and bottom walls having a length and a width;

each of the side walls having a length and a height, and each of the end walls having a height and a width, the widths of each of the end walls being substantially equal;

the first and second end walls of each enclosure being rectangular in shape, the first end wall of each enclosure comprising a door and including means for pivotally mounting said door to provide access to the enclosure;

the lengths of the top and bottom walls of the first and second enclosures being longer, by at least a factor of two, than the widths of the walls;

the top and bottom walls of each enclosure being rectangular in shape;

the end walls of both the first and second enclosures being oriented vertically;

the first and second side walls of the first and second enclosures each having four corners, the corners adjacent to each of the bottom walls and each of the first end walls defining an angle greater than ninety degrees and the corners adjacent to each of the bottom walls and each of the second end walls defining an angle less than ninety degrees;

wherein the bottom walls of the first and second enclosures each defines a floor thereof that is inclined downwardly as it extends from the first end wall to the second end wall thereof;

the first golf club bag being disposed in the first enclosure and the second golf club bag being disposed in the second enclosure;

each golf club bag including a plurality of golf clubs;

each golf club bag having a longitudinal axis and comprising generally an open top and a closed bottom;

each golf club bag having its longitudinal axis generally disposed parallel to the bottom wall of each enclosure and its open top adjacent to the respective first end wall, for urging the golf clubs in each of the golf club bags toward the bottom of each golf club bag.

* * * * *